US012599212B2

(12) United States Patent
Lapize et al.

(10) Patent No.: US 12,599,212 B2
(45) Date of Patent: Apr. 14, 2026

(54) METHOD FOR TREATING THE HAIR

(71) Applicant: L'OREAL, Paris (FR)

(72) Inventors: Sandy Lapize, Saint-Ouen (FR); Melissa Champeaux, Saint-Ouen (FR); Diana Hejjaoui, Clichy (FR)

(73) Assignee: L'OREAL, Paris (FR)

( * ) Notice: Subject to any disclaimer, the term of this patent is extended or adjusted under 35 U.S.C. 154(b) by 881 days.

(21) Appl. No.: 17/774,050

(22) PCT Filed: Oct. 28, 2020

(86) PCT No.: PCT/EP2020/080311
§ 371 (c)(1),
(2) Date: May 3, 2022

(87) PCT Pub. No.: WO2021/089384
PCT Pub. Date: May 14, 2021

(65) Prior Publication Data

US 2022/0369784 A1 Nov. 24, 2022

(30) Foreign Application Priority Data

Nov. 5, 2019 (FR) ..... 19 12388

(51) Int. Cl.
*A45D 2/36* (2006.01)
*A45D 1/00* (2006.01)
*A45D 7/06* (2006.01)

(52) U.S. Cl.
CPC ..... *A45D 7/06* (2013.01); *A45D 2/365* (2013.01); *A45D 2001/008* (2013.01)

(58) Field of Classification Search
CPC ... A45D 7/00; A45D 7/02; A45D 7/06; A45D 2007/002; A45D 2/00; A45D 2/001;
(Continued)

(56) References Cited

U.S. PATENT DOCUMENTS 2,758,606 A * 8/1956 Usai ..... A45D 24/24 132/110
2013/0192625 A1* 8/2013 Migliori ..... A45D 1/28 132/211

(Continued)

FOREIGN PATENT DOCUMENTS

EP 2 449 909 A1 5/2015
EP 3 554 306 A1 10/2019

(Continued)

OTHER PUBLICATIONS

International Search Report issued Jan. 28, 2021 in PCT/EP2020/080311 filed on Oct. 28, 2020, 3 pages.

(Continued)

*Primary Examiner* — Rachel R Steitz
*Assistant Examiner* — Karim Asqiriba
(74) *Attorney, Agent, or Firm* — Oblon, McClelland, Maier & Neustadt, L.L.P.

(57) ABSTRACT

A method for treating the hair with the aid of a treatment device, notably a heat treatment device, in particular a straightening device, in which a lock of hair is exposed, while the device is being moved along the latter, in a single operation to: apply cosmetic composition with the aid of an application member of the device, and then to apply steam with the aid of a steam outlet of the device that is offset relative to the application member in the direction of movement of the lock of hair by a nonzero distance v, measured between the median plane of the steam outlet and the median plane of the application member, of less than or equal to 10 mm.

15 Claims, 7 Drawing Sheets

(58) Field of Classification Search
CPC ... A45D 1/04; A45D 1/06; A45D 1/08; A45D 1/18; A45D 1/20; A45D 2001/008; A45D 4/04; A45D 19/16
See application file for complete search history.

(56) References Cited

U.S. PATENT DOCUMENTS

| | | | | |
|---|---|---|---|---|
| 2015/0289620 | A1* | 10/2015 | Nuzzo | A45D 2/02 132/211 |
| 2016/0324291 | A1* | 11/2016 | Fereyre | A45D 19/16 |
| 2017/0340082 | A1* | 11/2017 | Bonnemaire | A45D 2/001 |
| 2018/0213909 | A1* | 8/2018 | Fereyre | A45D 1/06 |
| 2018/0213913 | A1* | 8/2018 | Fereyre | A45D 19/16 |
| 2018/0360184 | A1* | 12/2018 | Fereyre | A45D 2/001 |
| 2019/0008257 | A1* | 1/2019 | Debauge | A45D 1/00 |
| 2019/0289980 | A1 | 9/2019 | Woodland et al. | |
| 2020/0214418 | A1* | 7/2020 | Gandini | A45D 1/06 |

FOREIGN PATENT DOCUMENTS

| | | | |
|---|---|---|---|
| FR | 2 967 018 | A1 | 5/2012 |
| FR | 3 015 874 | A1 | 7/2015 |
| FR | 3 039 373 | A1 | 2/2017 |
| WO | WO 2009/078046 | A1 | 6/2009 |
| WO | WO 2013/045331 | A1 | 4/2013 |
| WO | WO 2013/090896 | A1 | 6/2013 |
| WO | WO 2014/064660 | A1 | 5/2014 |
| WO | WO 2015/097625 | A2 | 7/2015 |
| WO | WO 2018/091577 | A1 | 5/2018 |

OTHER PUBLICATIONS

Preliminary French Search Report issued Aug. 21, 2020 in French Application 19 12388 filed on Nov. 5, 2019, 3 pages (with English Translation of Categories of Cited Documents).

* cited by examiner

METHOD FOR TREATING THE HAIR

The present invention relates to a method for treating the hair with the aid of a treatment device, involving the application of a cosmetic composition and the application of steam.

PRIOR ART

Numerous methods for treating the hair, in particular for straightening the hair, have already been proposed, implementing the application of a haircare composition and steam to the hair.

Usually, straightening methods consist in manually closing, over the lock of hair to be straightened, two arms that are connected together with the aid of a hinge bearing a heating element disposed on one of the arms. The lock of hair is then subjected to the heat emitted by the heating element, until the two arms are opened and the lock of hair is removed. Certain known methods allow the application of a cosmetic composition.

This is the case, for example, in the international applications WO 2009/078046, WO 2013/045331 and WO 2013/090896, which describe a method for treating the hair with a device having two arms that are connected together so as to allow the appliance to be opened and closed, at least one heating member and at least one seat for accommodating a device for the heat treatment of hair, the latter allowing a haircare composition to be dispensed during operation. The treatment device may have a support material impregnated with a haircare composition.

The international applications WO 2014/064660 and WO 2015/097625 disclose hair treatment methods involving the application of a cosmetic composition by an application member mounted on a cosmetic composition refill that is received in a housing of a treatment device of the type described above and the application of steam via a steam outlet present on one of the arms.

The international application WO 2018/091577 describes a device for the heat treatment of the hair, having a steam outlet and allowing the application of a cosmetic composition via a refill fitted on one of the arms. The refill has a reservoir, into which a porous application member partially extends, which is fixed in the reservoir and centered relative to the latter.

In such devices, the steam outlet is spaced apart from the application member on account of its being centered on the refill. The water vapor is thus applied in a large volume, this reducing the effectiveness of straightening. In addition, the steam comes into contact with cold walls, in particular walls of the refill, causing it to condense, this not being desirable in particular as regards the comfort of use, and the potential presence of water can make the design more complicated as regards electrical safety.

There is a need to further improve hair treatment methods allowing the application of a cosmetic composition and steam for an effective and safe treatment.

SUMMARY OF THE INVENTION

The invention aims to meet this need and its subject, according to a first of its aspects, is a method for treating the hair with the aid of a treatment device, notably a heat treatment device, in particular a straightening device, wherein a lock of hair is exposed, while the device is being moved along the latter, in a single operation to:

- an application of cosmetic composition with the aid of an application member of the device, and then to
- an application of steam with the aid of a steam outlet of the device that is offset relative to the application member in the direction of movement of the lock of hair by a nonzero distance, measured between the median plane of the steam outlet and the median plane of the application member, of less than or equal to 10 mm.

Such a method allows successful treatment of the hair, in particular effective straightening of the hair with optimal confinement of the steam.

The fact that the steam outlet is close to the application member makes it possible to contain the steam in a smaller space of the device during the treatment in order to improve the application of steam to the hair and limit the condensation of the steam toward the electrical parts of the device.

Preferably, the distance between the steam outlet and the application member relative to the direction of movement of the lock of hair is less than or equal to 8 mm, in particular between 2 mm and 8 mm.

Preferably, the method involves the introduction of a lock of hair between two arms, connected together so as to be movable relative to one another, of the device, and the closure of the two arms one over the other, the application of the cosmetic composition by the application member mounted on one of the arms and the application of steam via the steam outlet mounted on one of the arms.

Preferably, the method involves the heating in contact with at least one heating element mounted on the device, in particular one of the arms, preferably by passing between two heating elements that are each mounted on an arm and face one another, the heating taking place, advantageously, after the applications of cosmetic composition and steam. This or these heating element(s) may each have a plate, made of a material that is a good conductor of heat, that defines a hot surface for contact with the hair, the temperature of said surface being for example greater than or equal to 95° C., better still between 90 and 230° C.

Preferably, the device for treating the hair according to the invention is a straightener having flat heating elements, in particular which face one another when the arms are closed.

Preferably, during the treatment, the steam outlet is disposed between two surfaces that come to bear on the hair, in particular the heating element(s) intended to come into contact with the hair, and the application member.

Preferably, the steam outlet is at a distance from two surfaces that come to bear on the hair, in particular the heating element(s), measured from the median plane of the steam outlet to the closest edge of the two surfaces, of less than or equal to 10 mm, better still less than or equal to 8 mm.

Preferably, during the application of cosmetic composition, the lock of hair is compressed against the application member by a pressing element, in particular disposed on the other arm facing the application member. The lock of hair is advantageously compressed against the application member by the pressing element with a constant and uniform pressure regardless of the pressure exerted by the user, in particular a pressure of between 1 and 5 N, better still between 2 and 4 N. This can be realized by the fact that the pressing element and/or a support of the application member is mounted on an elastic member, in particular a spring. This allows a calibrated and regular deposition of cosmetic composition during the treatment and different treatment operations, in particular different straightening operations, regardless of the clamping force applied by the user to the handpiece.

Preferably, the application member extends along the steam outlet relative to the direction of movement of the lock of hair during the treatment. The application member preferably has a length greater than or equal to that of the steam outlet.

Preferably, the steam emitted by the steam outlet, during the implementation of the method, is confined in the device in a space having a volume less than or equal to 1300 $mm^3$, better still less than or equal to 1200 $mm^3$, preferably between 700 $mm^3$ and 1200 $mm^3$, better still between 900 $mm^3$ and 1100 $mm^3$, for example around 1000 $mm^3$. The confined space may be delimited, on one side, by the application member bearing on the hair against the pressing element and, on the other side, by two surfaces that come to bear on the hair, in particular the heating element(s).

Preferably, the steam outlet has a plurality of orifices through which the steam is emitted toward the lock of hair, the orifices extending along a longitudinal axis parallel to the longitudinal axis of the device, in particular of the arm bearing the steam outlet.

The application member is preferably mounted on the device via a support to which it is fastened.

Preferably, the support has a reservoir, the application member being in contact with the cosmetic composition contained in the reservoir, in particular in a cavity in the reservoir, the application member extending in particular partially into the cavity in the reservoir of cosmetic composition.

Preferably, the cosmetic composition contained in the reservoir is liquid.

Preferably, the cosmetic composition is applied to the hair in the liquid state.

Preferably, the cavity is at least partially without a porous element. The cosmetic composition is at least partially contained in the cavity in the free liquid state, that is to say not impregnated in a porous element.

The volume of the cavity may be less than or equal to 100 mL, better still less than or equal to 50 mL, in particular between 25 mL and 5 mL, better still between 15 mL and 10 mL.

The length of the cavity may be between 30 and 200 mm, better still between 50 and 150 mm, even better still between 70 and 110 mm.

Preferably, the application member extends through an opening in the reservoir that is offset laterally toward the steam outlet relative to the longitudinal axis of the reservoir. The lateral offset of the opening into which the application member is fitted makes it possible to have the above-described gap between the steam outlet and the application member. It is thus possible to reduce the distance between the elements of the treatment device, thereby improving the treatment of the hair. The off-center nature of the application member confines the steam in a small volume, making the heat treatment, in particular the straightening, more effective and reducing the risks of the steam condensing. The reduction in the risk of the steam condensing on the appliance reduces the risk of the user being scalded by the water.

Preferably, the opening in the reservoir has a length substantially equal to the length of the cavity. This makes it possible to have good contact between the application member and the cosmetic composition, thereby improving the dispensing of cosmetic composition into the application member.

Preferably, the opening has a constant width along its length and over its height.

In a variant, the opening has a variable width, in particular over its height. It may have, in cross section, a width that is greater where it leads into the cavity. This makes it possible to increase the contact area between the application member and the composition, and to avoid excessive compression of the latter while having a good seal between the application member and the opening, avoiding leakage of liquid. The opening may have a section that widens toward the exterior of the reservoir when the device is viewed in cross section.

Preferably, the opening has, in cross section, a parallel median plane that is spaced apart from the longitudinal axis of the reservoir by a nonzero distance, which is preferably constant along the longitudinal axis of the reservoir. Preferably, the distance between the median plane of the opening and the longitudinal axis of the reservoir is between 30 and 100%, better still between 70 and 100%, of the distance, measured perpendicularly to the median plane of the opening, between the longitudinal axis of the reservoir and the lateral wall of the cavity. When the cavity is cylindrical with a circular base, the distance, measured perpendicularly to the median plane of the cavity, between the longitudinal axis of the reservoir and the lateral wall of the cavity is the radius of the circular base.

The reservoir may be opaque, translucent or transparent, preferably being transparent. The reservoir may be opaque and have a translucent or transparent window.

The reservoir may have a cosmetic-composition filling orifice closed by a removable stopper. In a variant, the reservoir is not intended to be refilled and does not have such a filling orifice separate from the opening into which the application member is fitted. When a filling orifice is provided, it is preferably situated at an axial end of the reservoir, advantageously making it possible to benefit from the cylindrical shape of the reservoir so as to form a neck allowing the removable mounting of the stopper.

The reservoir may have a removable or non-removable end cap. Such a cap may be provided to close the reservoir after it has been filled with cosmetic composition while it is being manufactured and not to be removable, in particular being force-fitted, bonded or welded, with or without snap-fastening. In a variant, the cap is removable and allows the reservoir to be filled when it is empty. The cap may have a sealing skirt of tubular shape.

It is possible for the reservoir not to have an air intake orifice. This is because the application member is sufficiently porous to allow air to enter. In a variant, the reservoir has an air intake orifice. The size of this orifice is small enough to avoid leakage of liquid through it when the device is turned over.

Preferably, the application member has a length substantially equal to, or even slightly greater than, the length of the opening in the reservoir, and preferably substantially equal to, or even slightly greater than, the length of the cavity.

Preferably, the method does not exhibit any movement of the application member in the reservoir during the treatment. This makes it possible to have an application member with a position in the reservoir that is the same regardless of the level of cosmetic composition in the cavity and the pressure exerted on the application member when the cosmetic composition is being applied to the hair. Thus, the amount of cosmetic composition delivered when treating the hair is relatively independent of the orientation of the device. The application of cosmetic composition by the application member is thus more easily controllable and reproducible. In addition, the fact that the application member is immovable limits the risk of cosmetic composition leaking out at the opening.

The method may have a step of evaluating the amount of cosmetic composition remaining in the reservoir, in particular as a result of the at least partially transparent nature of the reservoir. The method may have a step of filling the reservoir with cosmetic composition, in particular through a filling orifice of the reservoir, which is closed by a removable stopper.

Preferably, the application member is sufficiently rigid to maintain its shape during application. This makes it possible in particular to avoid a "pump effect" during application.

The application member may be made of a material capable of transporting the cosmetic composition by capillary action, while being capable of retaining the composition so as to avoid the latter flowing under the effect of its weight out of the application member.

The application member is preferably entirely porous.

Preferably, the application member is made of felt. In the latter case, the fibers of the felt may all be oriented substantially in the same direction, the fibers preferably being oriented perpendicularly to the surface of the lock of hair to be treated or parallel to a longitudinal direction of the application member.

In a variant, the application member is made from a sintered material, in particular a plastic, preferably thermoplastic, sintered material, for example a polyolefin, in particular a PE, sintered material, for example a sintered material sold by the company Porex Corporation under the reference XS-49010.

The application member may be molded or preferably extruded.

Preferably, the application member has a substantially prismatic shape, in particular the shape of a parallelepiped, especially a right parallelepiped.

The thickness of the application member may be less than or equal to 3 cm, better still between 0.5 mm and 20 mm, even better still between 1 mm and 8 mm. Such a thickness makes it easier to rapidly soak the application member to the core, in particular during the treatment and between the different treatments, while having an application of cosmetic composition upon each movement of the device over a lock of hair.

The application member may have a rounded application surface in order to make application to the hair easier.

The porosity of the application member, defined by the ratio of the volume of the pores to the total volume of the material, may be between 0.05 and 2.

The application member may have a density of between 0.11 and 0.8 g/cm$^3$, better still between 0.25 and 0.5 g/cm$^3$, better still between 0.35 and 0.45 g/cm$^3$.

Such a porosity and such a density allow good retention of the cosmetic composition in the application member while allowing a good supply of cosmetic composition to the application surface by capillary action. Preferably, the porosity of the application member is chosen depending on the viscosity of the cosmetic composition such that, when the application member is oriented with the opening of the cavity downward, the application member is soaked with cosmetic composition but the latter does not flow out of the application member under gravity.

The cosmetic composition may be an anhydrous or aqueous composition.

Preferably, when the cosmetic composition is in an oily form, the application member is hydrophobic. This allows better diffusion of the cosmetic composition in the application member.

Preferably, when the cosmetic composition is in an aqueous form, the application member is hydrophilic. This allows better diffusion of the cosmetic composition in the application member.

Preferably, the application member is fixed relative to the reservoir, that is to say not removable. This makes it possible to ensure better sealing of the reservoir and reduces the risk of contamination of the application member, thereby improving the hygiene of the device.

In a variant, the application member is mounted in the reservoir in a removable manner. This makes it possible, when this is desirable, to easily replace a worn-out application member without having to change the reservoir. The application member may be simply retained in the opening by friction.

Preferably, the support of the application member is a cosmetic composition refill that is removable from the treatment device. The method may have a prior step of inserting the refill into a corresponding housing of the device, in particular on one of the arms of the device. Preferably, the refill is inserted by sliding a fastening profile of the refill in a complementary insertion guide on the device, in particular one of the arms, along an axis parallel to the longitudinal axis of the device, in particular of the arm.

Preferably, the refill is elongate and extends along the device, in particular along the arm on which it is mounted, along a length greater than or equal to the length of the steam outlet.

When the application member is mounted on a cosmetic composition refill, the method may have a step of changing the refill depending on the level of cosmetic composition in the refill, in particular when the reservoir is not intended to be refilled, or in order to change the cosmetic composition to be applied.

Preferably, when the application member is mounted on a refill, the application member has a lateral surface that is flush with or touches a surface of the device, in particular of the arm on which the refill is mounted. This limits the area of the refill in contact with the steam. Specifically, the application member forms a seal to the passage of the steam.

The method may have a prior step of removing a removable cover covering the application member, in particular mounted on the refill. This step may take place before or after the refill is mounted on the device, as the case may be, preferably before the refill is mounted on the device.

A combing action may be carried out, preferably before the applications of cosmetic composition and steam, by passing through a comb.

Preferably, the hair introduced between the arms comes into contact with the application member before being exposed to the steam and to the heating elements while the lock is being moved between the arms of the appliance.

DETAILED DESCRIPTION

In the rest of the description, identical or similar elements or elements having identical or similar functions bear the same reference signs. For the sake of conciseness, these elements are not repeatedly described for all the figures, and only the differences between the embodiments may be indicated.

Figure 1:
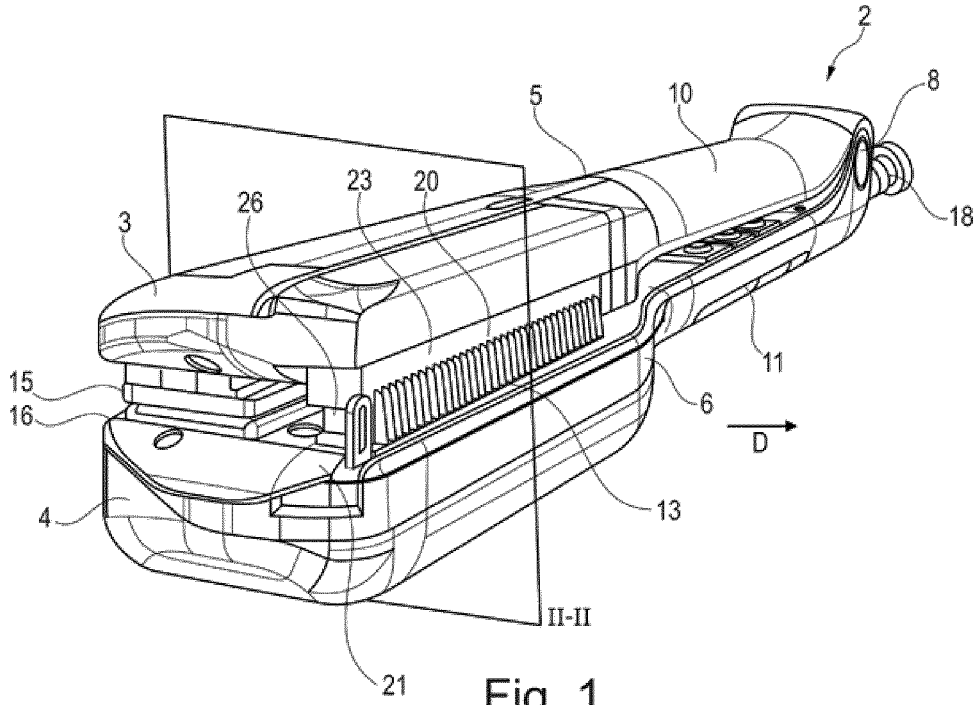
FIG. 1 shows a perspective view of an example of a device for treating the hair.
Figure 2:
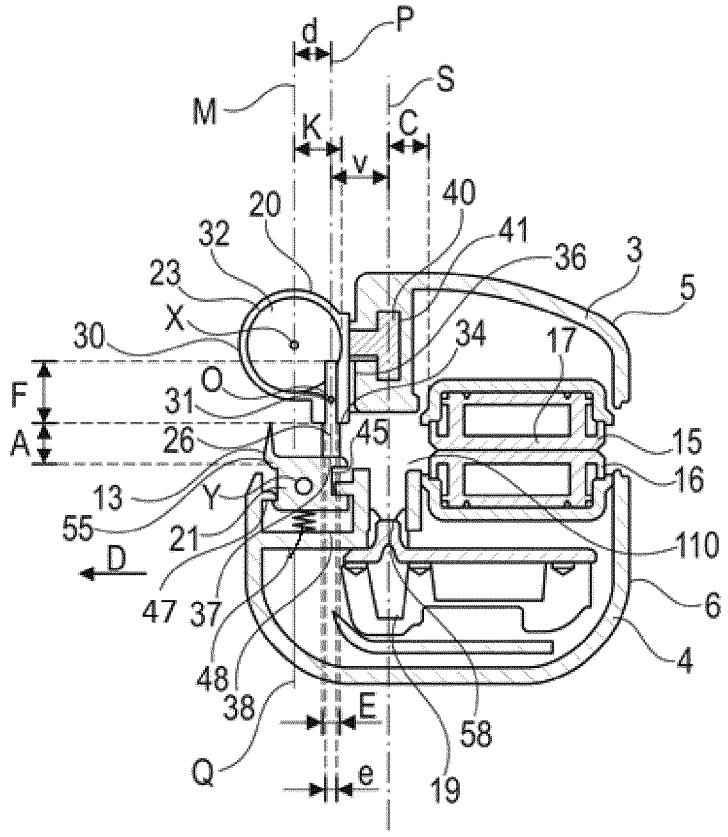
FIG. 2 is a view in section on II-II in FIG. 1, FIG. 3 schematically shows a perspective view of an example of a refill according to the invention.

FIGS. 1 and 2 show the handpiece 2 of an example of a device for the heat treatment of the hair according to the invention.

This handpiece 2 has two jaws 3 and 4 that are movable relative to one another between a spaced-apart configuration (not shown) for introducing a lock of hair between said jaws, and a moved-together configuration for treatment.

The jaws 3 and 4 are carried by an upper arm 5 and a lower arm 6, respectively, which, in the example in question, are connected together at one end by a joint 8, the handpiece 2 thus forming tongs.

The upper arm 5 and lower arm 6 each preferably have a total length of between 22 cm and 37 cm, preferably 31 cm, and define, between the joint 8 and the jaws 3 and 4, respective half-handles 10 and 11 on which the user can press in order to move the jaws 3 and 4 together.

An elastic return member (not visible) is preferably provided to return the jaws 3 and 4 into the spaced-apart configuration, this elastic return member being for example a spring disposed around a pin of the joint 8.

The invention is not limited to one particular way of connecting the upper arm 5 and the lower arm 6 together and the jaws 3 and 4 can be rendered movable in some other way without departing from the scope of the present invention. However, the presence of a joint is largely preferred for the ergonomics it provides.

The handpiece 2 is configured to carry out a heat treatment on the hair by contact with two heating elements 15 and 16. The invention is not limited to the presence of two heating elements, it being possible for only one heating element to be present if need be.

The jaws 3 and 4 define between one another a surface 17 for treating the hair, said surface being intended to receive a lock of hair to be treated, the handpiece 2 being moved along said lock during the treatment, for example in the direction from the root of the hairs to the tip.

In the example in question, the handpiece 2 is configured to comb the hair by passing it through a comb 13, to apply a haircare composition, to treat the hair by way of steam and then to carry out the heat treatment of the hair by contact with the two heating elements 15 and 16.

Figure 4:
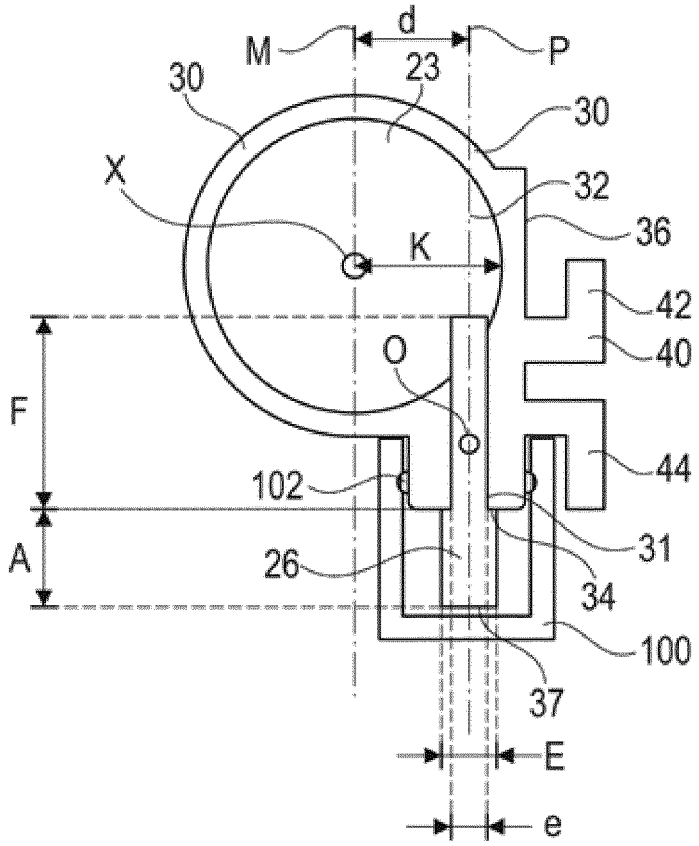
FIG. 4 is a view in section on Iv-Iv of the refill in FIG. 3, FIG. 5 schematically shows a perspective view of the refill in FIG. 3 in an exploded view.

The direction D of movement of the handpiece 2 over the hair, illustrated in FIG. 4, is preferably substantially perpendicular to the upper arm 5 and lower arm 6.

The handpiece 2 is connected by a line, in the example in question, to a base station (not shown) that is fixed during the treatment and is connected to the mains.

This base station provides electric power to the handpiece 2 and also supplies it with water for the purpose of generating steam, and can also carry out additional functions of processing electrical signals received from the handpiece 2. The line 18 that connects the handpiece 2 to the base station can thus have various electrical conductors and a water supply pipe.

A user interface (not shown in the figures) may be present on the handpiece 2 so as to allow the user for example to start up or not start up certain components thereof. The heating elements 15 and 16 are made of any material suitable for the heat treatment to be carried out, for example a metal, ceramic or glass in the form of plates.

The surface state of the plates 15 and 16, in the region of contact with the hair, depends on the desired heat treatment, and preferably the plates are smooth when the device is intended to straighten the hair.

Figure 3:
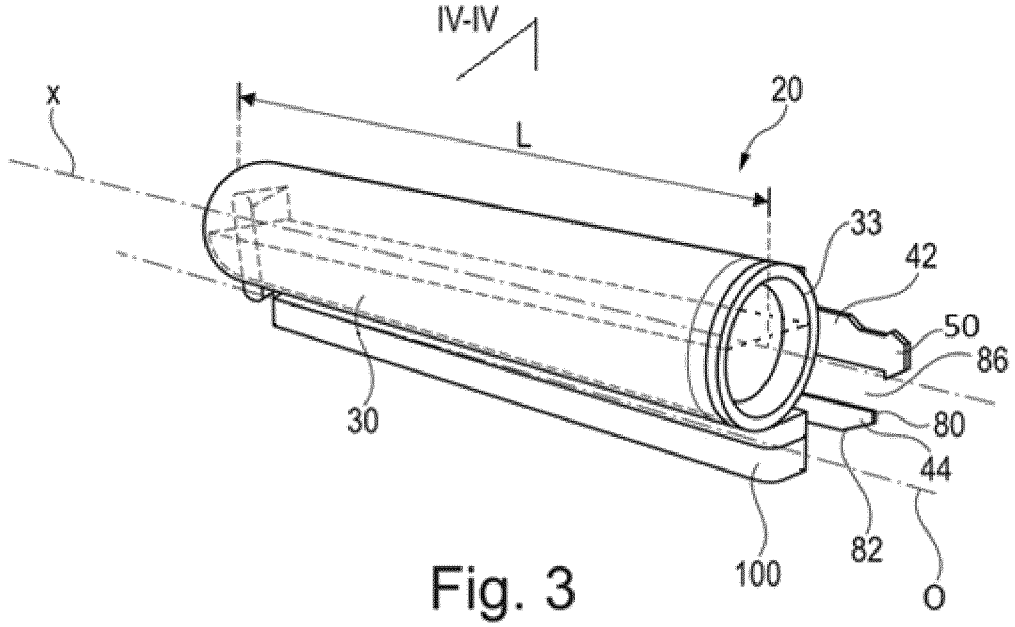

The length of the plates defines the extent of the treatment surface 17 perpendicularly to the direction D of movement of the handpiece 2 relative to the hair. The plates 15 and 16 define for example a treatment surface 17 that is flat and has a rectangular contour, as illustrated in FIG. 3.

One of the plates 15 and 16 is for example mounted in a fixed manner on the corresponding arm while the other is mounted in an articulated manner, for example with the aid of a ball joint, so as to allow the plates 15 and 16 to extend parallel to one another and to a median treatment plane in the closed configuration of the jaws. If appropriate, at least one of the plates is disposed on one of the arms 5 and 6, being supported by a structure that forms a spring.

The heating elements 15 and 16 may each have an electrical resistor electrically powered by the base station, preferably with temperature regulation by virtue of one or more sensors disposed in the vicinity of the heating resistors or in contact with the plates.

Treatment with steam is ensured by virtue of a vaporization member constituted by a resistive element present in an evaporation chamber 19 supplied with water by the base station. The latter may have an electrically driven pump, preferably a peristaltic pump, that draws up water to be sent to the handpiece 2 from a reservoir of water. The pump is for example as disclosed in the publication FR 2 967 018. The evaporation chamber may be produced in accordance with the teaching in the application EP 2449909A1 or in some other way, and communicate with at least one steam outlet.

The evaporation chamber 19 is disposed on one of the arms, namely the lower arm 6 in the example in question, and a steam outlet 58 is provided on the same arm 6.

The vaporization member is electrically powered by the base station and a temperature sensor is advantageously disposed in the evaporation chamber 19. The base station may be produced so as to control the electric power supply of the vaporization member in order to keep the temperature of the steam at the outlet 58 at a value of between 110° C. and 130° C.

The vaporization member is mounted on one of the arms, in particular the lower arm 6.

The steam outlet 58 is preferably at a distance c from the heating elements 15 and 16, measured between the median plane S of the steam outlet and the edge of the heating elements 15 and 16 that is closest to the steam outlet 58, of less than or equal to 10 mm.

The cosmetic composition is applied by a refill 20 carried by one of the two arms, 5 or 6, in this case the upper arm 5, which comes into contact with a pressing element 21 disposed on the arm opposite the one carrying the refill 20 facing the refill 20 during the closure of the arms when there is no hair therebetween. The pressing element 21 extends along the entire length of the refill 20 along a longitudinal axis Y. The refill 20 is elongate and extends along the corresponding arm 5 or 6.

The pressing element 21 is housed in a housing 38 through a front opening in the latter. The housing 38 also opens outward through at least one opening facing the application member 26.

In the example illustrated in FIG. 2, the pressing element 21 is introduced into its housing 38 by ribs 45 on the housing 38 being slid into corresponding grooves 47 in the pressing element 21. The ribs 45 are disposed on opposite lateral walls of the housing 38. The grooves 47 in the pressing element 21 are disposed on the lateral walls of the pressing element 21, which respectively face the lateral walls of the housing 38.

The pressing element 21 is movable along an axis Q perpendicular to the longitudinal axis Y, between a high position spaced apart from the bottom of the housing 38 that receives it and a low position moved together therewith.

The pressing element 21 bears against a support means 48, in particular one or more springs, extending in the housing 38, allowing the pressing element 21 to carry out a rocking movement and, in the open position of the arms 5 and 6, keeping the pressing element 21 in the high position.

The travel of the pressing element between its high position and its low position is between 1 mm and 5 mm, for example equal to around 3 mm. The movement of the pressing element 21 is limited by the bottom of the housing 38 or by the width/of the groove 47.

Figure 7:
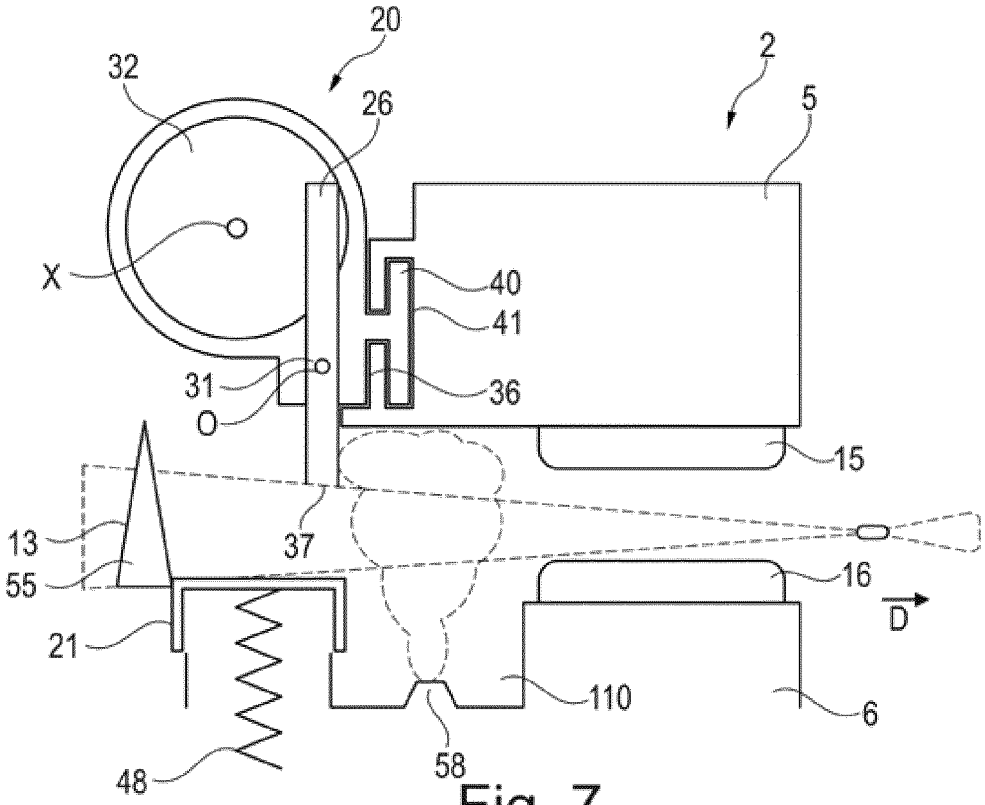
FIG. 7 shows the device in FIG. 6 while it is being closed over a lock of hair to be treated.
Figure 8:
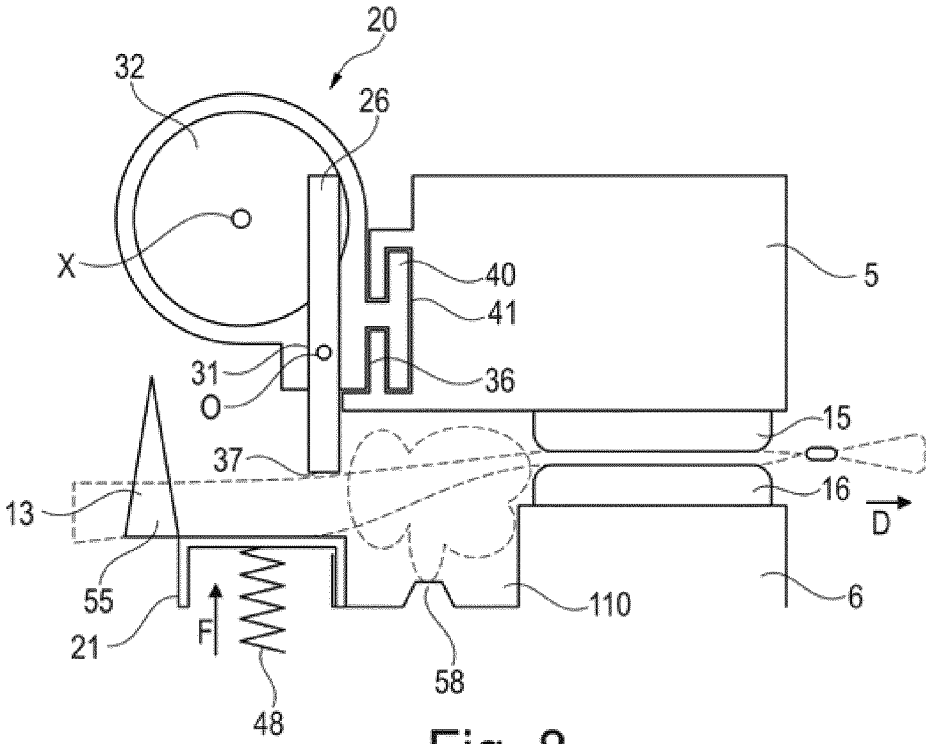
FIG. 8 shows the device in FIGS. 6 and 7 closed during the treatment of a lock of hair.

The travel of the pressing element 21 advantageously makes it possible to position the pressing element 21, in the closed position of the handpiece 2, such that the hairs are substantially aligned, that is to say without deviation of a lock of hair between the part situated between the heated plates and the part situated between the pressing element and the application member. In addition, this allows the hairs, during the use of the device, to be held against the application member with a constant and uniform pressure. This allows a calibrated and regular deposition of cosmetic composition during the treatment and different treatment operations, in particular different straightening operations. Preferably, as is illustrated in FIGS. 7 and 8, the pressing element 21 is configured to keep the hairs in contact with the application member 26 with a force F of between 1 and 5 N, better still between 2 and 4 N, regardless of the clamping force applied to the handpiece by the user.

The grooves 47 in the pressing element 21 have a width greater than the thickness of the ribs on the housing 38. Such a difference allows the pressing element 21 to move along the axis Q.

The refill 20, as can be seen more particularly in FIG. 2, has a reservoir 23 having a body 30. The latter delimits a cavity 32 containing a cosmetic composition. The refill 20 also has a porous application member 26 inserted into a slot-shaped opening 31 in the body 30 that is disposed so as to come into contact with the hairs extending between the arms.

Figure 5:
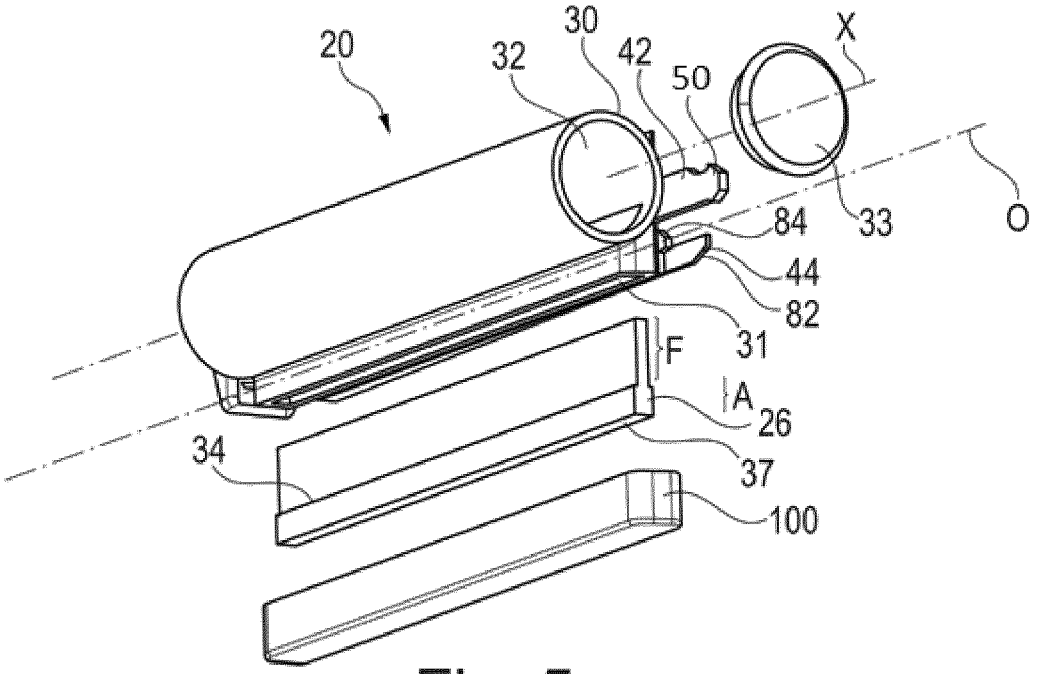

In the example illustrated, the reservoir 23 is elongate and extends along a longitudinal axis X and the cavity 32 is delimited by a lateral wall of the body 30 with a shape substantially in the form of a cylinder of revolution along the longitudinal axis X. As can be seen in FIG. 5, the cavity 32 is closed at its end by a circular cap 33. The cap 33 makes it possible, after the cavity has been filled with cosmetic composition during the manufacture of the refill, to close the end of the cavity in a sealed manner. The cap 33 may have a seal. It may be fastened by snap-fastening or in some other way. The cap 33 may be removable or preferably permanently fixed to the body 30 of the reservoir 23. The cap 33 may be arranged such that an attempt at removal causes the refill 20 to be damaged, preventing it from being reused.

The interior volume of the cavity 32 may be substantially equal to 12 mL.

Preferably, the cavity 32 extends along the longitudinal axis X along substantially the entire length of the arms 5 and 6.

The reservoir 30 has for example an inside radius K of between 1 mm and 10 mm, in particular substantially equal to 7.5 mm, and a length L along the longitudinal axis X equal to about 87 mm.

The reservoir 30 contains a cosmetic composition in a liquid form.

The reservoir 30 has a mounting flank 36 for the refill, said mounting flank being configured to face a surface of the device when the refill 20 is mounted on the device. This mounting flank 36 extends between the longitudinal axis X of the cavity and the treatment surface 17 of the device when the refill 20 is mounted on the device.

The opening 31 in the body 30 is provided in a portion of the latter that is offset laterally, relative to a median plane M of the cavity 30 parallel to the mounting flank 36 containing the longitudinal axis X, toward the mounting flank 36. The opening 31 opens on one side toward the outside of the body 30 of the refill 20 and on the other side into the cavity 32 and extends along the entire length of the cavity 32. The opening 31 forms a slot in the body 30 that extends along a longitudinal axis O, parallel to the longitudinal axis X, and has a constant section along the longitudinal axis O.

The opening 31 and the application member 26 exhibit one and the same median plane P, which is parallel to said median plane M of the cavity 30 and spaced apart from the latter by a distance d corresponding to a fraction of between 70 and 100% of the radius K of the cavity.

The application member 26 has a substantially rectangular parallelepipedal shape.

The application member 26 extends along the entire length of the opening 31 and fills it so as to prevent any leakage of cosmetic composition through the opening out of the application member 26 through the opening 31.

In the example illustrated in FIGS. 1 to 5, the application member 26 has an application portion A on the outside of the body 30 and a remaining portion F that is used in particular for fastening it, which extends through the opening 31 and into the cavity 32. In the example illustrated, the portion F has, in cross section through the refill, a thickness e that is less than the thickness E of the application portion A. Preferably, the thickness E of the application portion A is less than or equal to 20 mm, better still less than or equal to 8 mm, even better still less than or equal to 3 mm. Preferably, the junction between the portion F and the application portion A is formed by a shoulder 34 that butts against a wall of the body 30 and prevents the application portion A from being inserted into the opening 31. Preferably, the application member 26, in particular the portion F thereof, extends partially into the cavity 32.

The body 30 is made of thermoplastic material, for example polybutylene terephthalate (PBT), polyethylene terephthalate (PET), polyamide (PA), polypropylene, copolyester, in particular Tritan®, elastomer or a mixture thereof, in particular a mixture of PBT and PET. Preferably, the body 30 is transparent.

The application member 26 may have a rectangular parallelepipedal shape. The application member 26 thus has a substantially flat application surface 37 that is intended to be in contact with the hair to be treated.

In the example illustrated, the application member 26 is porous. It comprises, for example, a mixture of 50% polyethylene and 50% polypropylene.

In this embodiment, the material constituting the application member 26 is a felt. The fibers of the felt may be oriented parallel to the surface of the lock of hair to be treated, the fibers preferably being oriented substantially in a longitudinal direction of the application member, perpendicularly to the direction D of passage over the hair. According to one variant, the fibers of the felt of the application member are oriented perpendicularly to the surface of the lock of hair to be treated, and thus perpendicularly to the direction D and to the longitudinal direction of the application member 26.

In a variant, the application member 26 is made from a porous and hydrophobic sintered material, in particular from PE, for example Porex® sold by the company Porex Corporation.

The application member 26 preferably has a density of between 0.35 and 0.45 g/cm$^3$, for example substantially equal to 0.4 g/cm$^3$.

Preferably, the refill 20 is produced such that the application member 26 cannot be removed manually from the refill 23 through the opening 31 without damaging the refill 23, in particular the application member 26 and/or the body 30. In a variant, the application member 26 is mounted so as to be able to be removed manually from the body of the refill 23.

The refill 20 preferably has a fastening profile 40 by which it is fastened to one of the arms 5 or 6. The fastening profile 40 is inserted into a slideway 41 of complementary shape on the arm 5 or 6.

Preferably, the fastening profile 40 extends from the mounting flank 36, between the longitudinal axis X of the reservoir and the treatment surface 17 of the device when the refill 20 is mounted on the device.

In the example illustrated, the fastening profile 40 has the overall shape of a T, allowing the refill 20 to be held properly on the arm 5 or 6. As illustrated in FIGS. 3 to 5, the fastening profile 40 may have two profile elements 42 and 44, which fit into slideway elements 41 provided on the corresponding arm. However, any other way of fastening the refill that allows it to be mounted removably on the appliance may be adopted.

The refill 20 may have a hook 50 extending from the rear end of one of the two profile elements 42 or 44 and intended to cooperate with a clip in order to hold the refill in position, this hook 50 being for example snap-fastened in the clip at the end of its insertion into the device, and being able to be withdrawn therefrom by a mechanism of the push/pull type or the like.

The refill may also have, extending from the rear end of the profile element 42 or 44 that does not bear the hook 50, a positioning finger 80 that makes it easier for the profile elements 42 and 44 to be positioned with respect to the slideway elements of the device while the refill 20 is being fastened.

This positioning finger 80 may have a chamfer 82 on its opposite edge to the hook 50. Such a chamfer 82 makes positioning even easier.

The finger 80 may also, at the point where it meets the profile element 44, form a discontinuity 84 on the same side as the hook 50, the finger 80 being smaller in width than the profile element 44 from which it extends. Thus, the refill 20 has, between the finger 80 and the hook 50, a space 86 which is wider than the space between the two profile elements 42 and 44. Such a space 86 makes it easier to fasten the hook 50 to the clip of the corresponding device.

Figure 6:
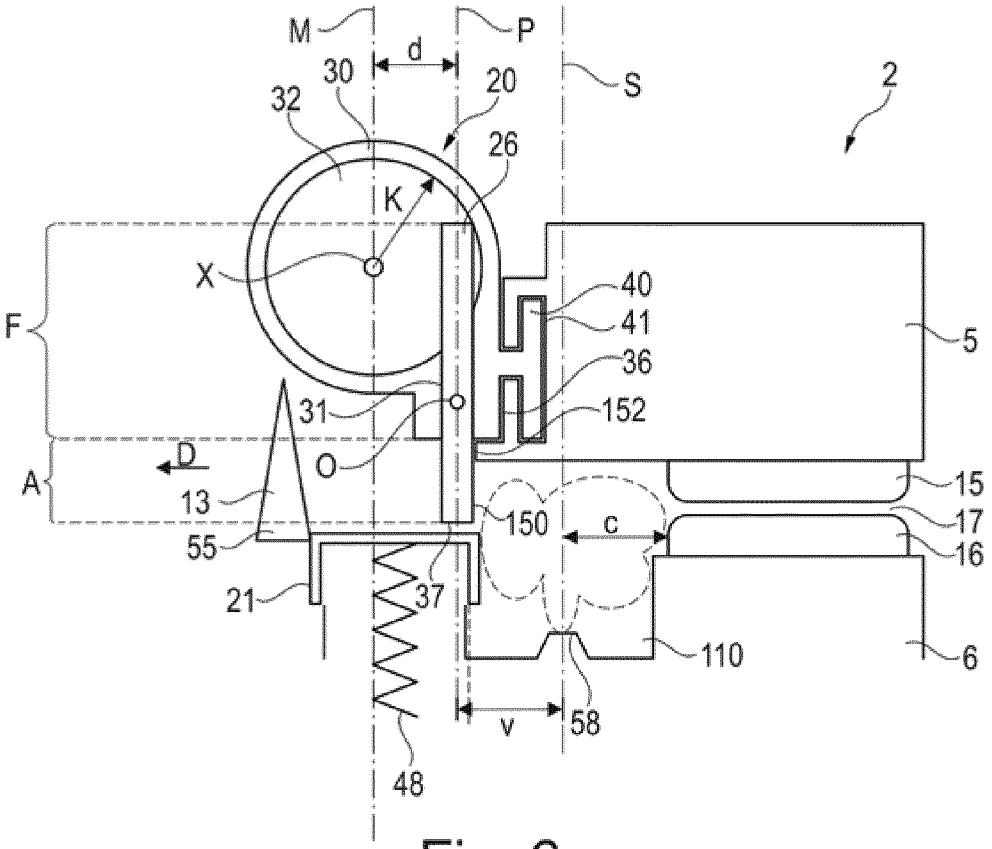
FIG. 6 shows an example of the device according to the invention.

The hook 50 may extend further to the rear than the positioning finger 80 such that the latter does not impede the snap-fastening of the hook 50 to the clip of the device. Preferably, as is illustrated in FIG. 6, when the refill 20 is mounted on the arm 4, the application member 26 is flush with a surface 152 of the arm 5 by way of one of its lateral walls 150. This makes it possible to prevent steam from passing between the application member 26 and the arm 5.

As illustrated in FIGS. 3 to 5, the refill 20 has a protective cover 100 for the removable application member 26. This cover 100 covers the application portion A of the application member 26, which protrudes from the body 30 of the refill 20 in order to protect it from the outside environment when the refill 20 is not in use and to limit the drying up of the cosmetic composition contained in the application member 26. As is illustrated in FIG. 4, the cover 100 can be kept in position on the body 30 by complementary reliefs 102 provided on the body 30.

When it is mounted on the refill 20, the protective cover 100 extends partially between the fastening elements 42 and 44 and the body of the refill, so as to prevent the refill from being inserted into the slideway 41. Thus, the risk of forgetting to take off the cover for use is avoided.

When the refill 20 is mounted on the arm 5 that carries it, the application member 26, and at the same time the opening 31, is at a distance v from the steam outlet 58, measured between the median plane P of the application member 26 or the opening 31 and the median plane S of the steam outlet, of less than or equal to 8 mm, for example substantially equal to 6 mm.

In the example illustrated in FIGS. 6 to 8, the handpiece 2 has a comb 13 situated in front of the application member 26 and the pressing element 21 in the direction D of movement of the handpiece 2. The comb 13 may be integral with the pressing element 21, in particular molded in one piece with the latter.

The comb 13 extends parallel to the pressing element 21 and along substantially the entire length thereof. It has a plurality of teeth 55.

While the handpiece 2 is being used, as is illustrated in FIGS. 7 and 8, the user closes the two arms 5 and 6 over a lock of hair and moves the handpiece 2, in the closed position, from the root of the hair to the tips of the latter. The hair is subjected:

- first of all to combing by the comb 13, which aligns the hairs with the treatment, in particular straightening, axis,
- then to application of haircare composition by the hairs being pressed against the application member 26 by the pressing element 21, with maintenance of a constant and uniform pressure on the lock of hair treated, then to application of steam via the steam outlet 58 in a space 110 confined, on one side, by the application member 26 bearing on the hairs against the pressing element 21 and, on the other side, by the two heating elements 15 and 16 bearing on the hairs, and finally to heating between two heating elements 15 and 16.

In the invention, the fact that the application member 26 is offset toward the mounting flank 36 and thus toward the treatment surface 17 makes it possible to have a space 110 of reduced volume compared with an application member centered on the refill, in particular between 1.1 and 2, better still between 1.2 and 1.5 times smaller than the volume of the space in the case of an application member centered on the refill. Such confinement of the steam makes it possible to have a greater concentration of steam in contact with the hair, thereby improving the treatment, in particular the straightening. In addition, such positioning of the application member 26 makes it possible to limit the area of the body 30 of the refill 20 and of the handpiece 2 that comes into contact with the steam during the treatment, thereby reducing the effect of the steam condensing, which occurs when the steam comes into contact with cold surfaces, and thus increasing the safety of the handpiece from an electrical point of view in particular.

Preferably, the space 110 has a volume of between 100 $mm^3$ and 2000 $mm^3$, better still between 700 $mm^3$ and 1200 $mm^3$, for example around 1000 $mm^3$.

Figure 10:
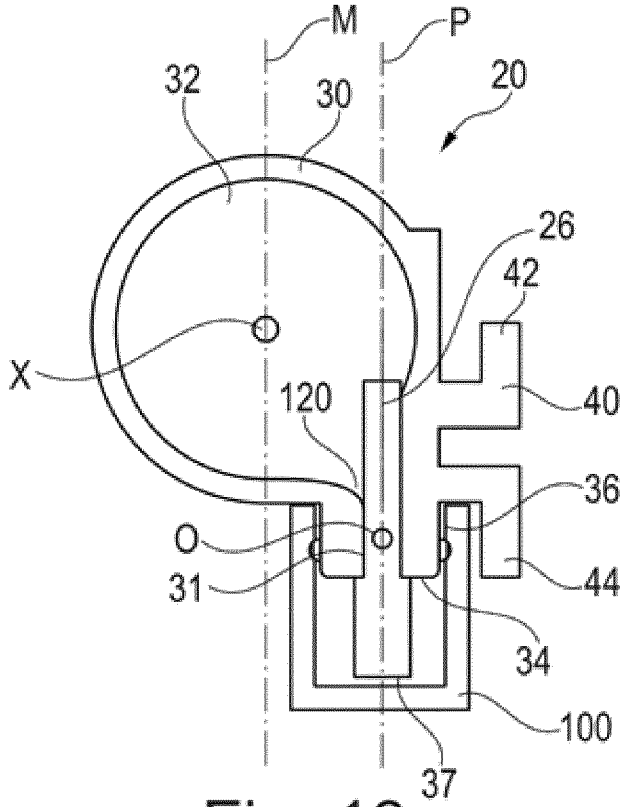

In a variant, as illustrated in FIGS. 6 to 8, the application member 26 comes into abutment against the interior wall of the cavity 32. Such abutment makes it possible to prevent the application member from shifting while the refill is being used, on account of the force exerted by the pressing element 21. The presence of a shoulder between the application portion A and the portion F is then not useful for obtaining this result. The refill illustrated in FIG. 10 differs from the one in FIGS. 1 to 5 in that the opening 31 has a widened portion 120 at the point where it leads into the cavity 32. Such a widened portion 120 allows the application member to be in contact more or less permanently with the cosmetic composition, regardless of the level thereof in the cavity 32.

Figure 11:
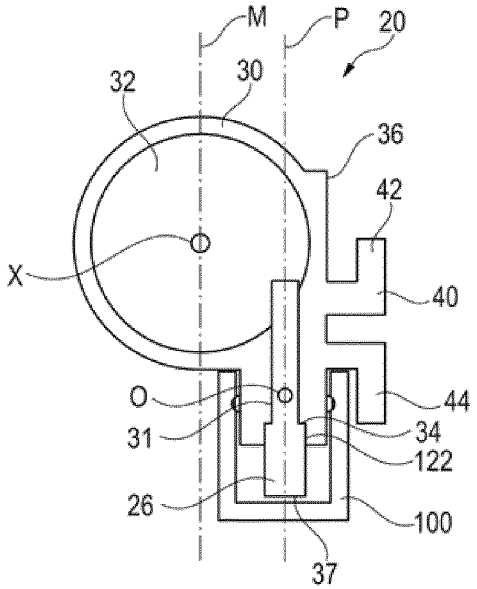

The refill illustrated in FIG. 11 differs from the one in FIGS. 1 to 5 in that the opening 31 has a widened portion 122 toward the outside.

Figure 12:
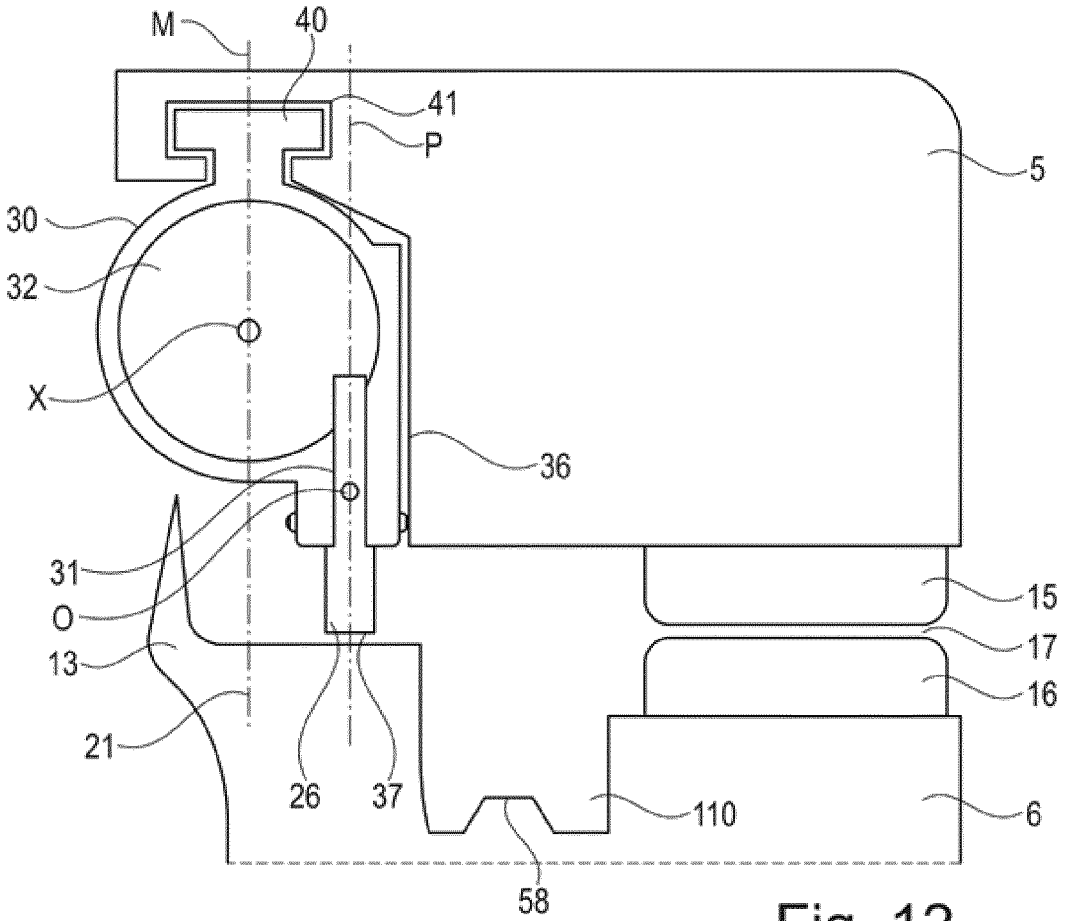

In the variant illustrated in FIG. 12, the fastening profile 40 is positioned on the body 30 in a different way from that described in relation to the preceding figures, in particular is not positioned on the mounting flank 36. The fastening profile 40 is positioned on an outer surface of the reservoir that extends over the top of the refill relative to the opening and the device is configured such that the complementary slideway 41 is positioned facing the pressing element on the arm 5 that carries the refill.

Figure 13A:
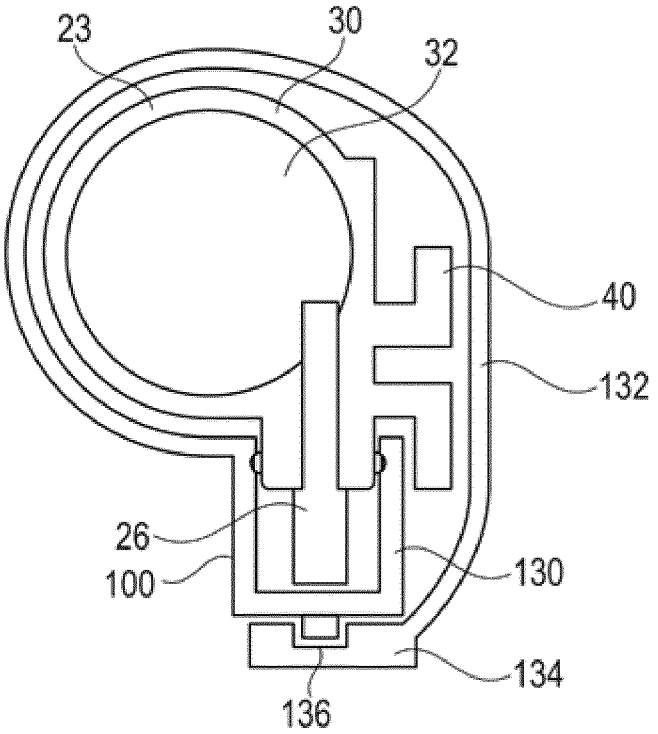
Figure 13B:
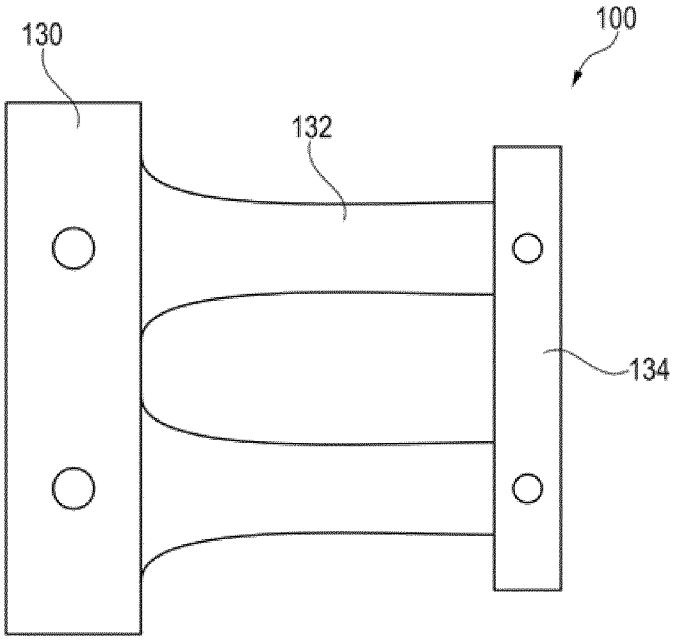

In a variant, as illustrated in FIGS. 13A and 13B, the protective cover 100 has a body 130, one or more flexible clamping strips 132 that extend from the body 130 and are configured to be wrapped around the refill in order to keep the cover 100 in position, and a locking part 134 at the distal end of the clamping strip(s) that is configured to be fastened by fastening means 136 on the body 130 of the cover once the strip(s) has/have been wrapped around the refill. The clamping strip(s) 132 is/are formed integrally with the body 130. During the mounting of the cover 100 on the reservoir, the body 130 of the cover is mounted on the reservoir so as to cover the application member 26, then the clamping strip(s) 132 is/are wrapped around the reservoir and the locking part 134 at the end thereof is fastened to the body 130 to keep the cover 100 in position.

EXAMPLE

A handpiece 2 and a refill 20 mounted on the handpiece 2 as were described above in relation to FIGS. 1 to 5 were used to apply a haircare composition to a sheet of absorbent paper.

In this example, the application member 26 has a density of 0.4 $g/cm^3$ and the reservoir has a volume of 12 mL.

Figure 9:
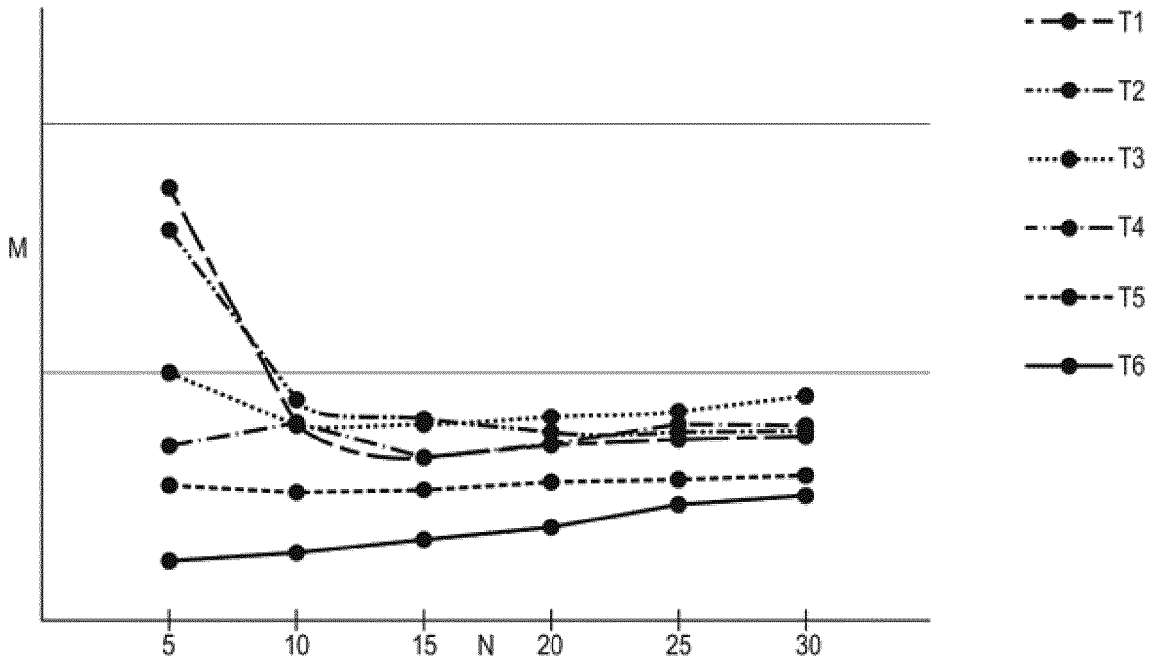
FIG. 9 is a curve showing the mass of cosmetic composition applied with the device as a function of the number of passages of a device according to the invention over a piece of absorbent paper, FIG. 10 schematically shows a view in cross section of a variant refill according to the invention, FIG. 11 schematically shows a view in cross section of a variant device according to the invention, FIG. 12 schematically shows a view in cross section of a variant device according to the invention, FIG. 13A schematically shows a variant refill according to the invention, and FIG. 13B schematically shows the protective cover of the refill in FIG. 13A.

The handpiece 2 carrying the refill 20 was passed several times over the sheet of paper and the mass of cosmetic composition from the reservoir that was applied to the paper on each pass was measured; a curve corresponding to the mass of cosmetic composition M applied on each pass is given in FIG. 9 as a function of the number of passes N. The measurements were taken over several temporally spaced-apart applications T1 to T6 without the refill 20 being changed or refilled with cosmetic composition. Between two consecutive applications T1 to T6, the cap 100 was disposed on the refill 20 to protect the application member 26 from drying out. The different measurements are shown in FIG. 9 for each application.

These curves show that the mass of cosmetic composition applied is substantially constant on each pass during one application and that the mass of cosmetic composition applied is likewise substantially constant over two temporally spaced-apart applications, without it being necessary to refill the reservoir with cosmetic composition. However, it is useful to fit the cap 100 between two applications in order to prevent the cosmetic composition from drying up between two applications.

The invention is not limited to the exemplary embodiments that have just been described, the features of which may be combined with one another within variants that are not illustrated.

For example, the fastening profile may be disposed in some other way on the refill, the cavity may be cylindrical with a polygonal base, the cover may be fastened to the refill in some other way, and in particular it may be possible for it not to prevent the mounting of the refill on the handpiece.

The application member may be mounted directly on the device.

The application member may be mounted on a support mounted on a spring.

The invention claimed is:

1. A method for treating hair with aid of a treatment device, wherein a lock of hair is exposed, while the device is being moved along the lock of hair, in a single operation to:

an application of cosmetic composition with aid of an application member of the device, and then to an application of steam with aid of a steam outlet of the device that is offset relative to the application member in a direction of movement of the lock of hair by a nonzero distance v of less than or equal to 10 mm, the nonzero distance v being measured between a median plane of the steam outlet and a median plane of the application member, wherein the application member is mounted on the device via a support having a cavity, the cavity defining a reservoir containing the cosmetic composition, the reservoir comprising an opening that is offset laterally relative to a median plane of the reservoir containing a longitudinal axis of the reservoir in a direction of the steam outlet, the application member extending through the opening of the reservoir and being in contact with the cosmetic composition contained in the reservoir.

2. The method as claimed in claim 1, wherein the distance v between the steam outlet and the application member relative to the direction of movement of the lock of hair is less than or equal to 8 mm.

3. The method as claimed in claim 1, which involves an introduction of the lock of hair between two arms of the device that are connected together and movable relative to one another, and closure of the two arms one over the other, the application member and the steam outlet each being mounted on one of the two arms.

4. The method as claimed in claim 1, which involves heating of the lock of hair in contact with at least one heating element mounted on the device.

5. The method as claimed in claim 4, wherein the heating of the lock of hair is performed by passing it between two heating elements that are each mounted on an arm and face one another, this heating taking place after the application of cosmetic composition and the application of steam.

6. The method as claimed in claim 1, wherein, during a treatment, the steam outlet is disposed between two surfaces that come to bear on the lock of hair and the application member.

7. The method as claimed in claim 1, wherein the steam outlet is at a distance from two surfaces that come to bear on the lock of hair measured from the median plane of the steam outlet to a closest edge of the two surfaces, of less than or equal to 10 mm.

8. The method as claimed in claim 1, wherein, during the application of cosmetic composition, the lock of hair is compressed against the application member by a pressing element with a constant and uniform pressure regardless of pressure exerted by a user.

9. The method as claimed in claim 8, wherein the steam emitted by the steam outlet is confined in the device in a space having a volume less than or equal to 1300 $mm^3$.

10. The method as claimed in claim 9, wherein the space is delimited, on one side, by the application member bearing on the lock of hair against the pressing element and, on the other side, by two surfaces that come to bear on the lock of hair.

11. The method as claimed in claim 1, wherein the application member is made of a material capable of transporting the cosmetic composition by capillary action, while being capable of retaining the cosmetic composition so as to avoid the latter flowing under an effect of its weight out of the application member.

12. The method as claimed in claim 1, wherein a thickness of the application member is less than or equal to 3 cm.

13. The method as claimed in claim 1, wherein a support of the application member is a cosmetic composition refill that is removable from the treatment device, the method involving a prior step of inserting the refill into a housing of the device.

14. The method as claimed in claim 13, wherein the application member has a lateral surface that is flush with or touches a surface of the device.

15. The method as claimed in claim 1, which involves a prior step of removing a removable cover covering the application member, and/or a combing action by passage through a comb.

* * * * *